United States Patent [19]

Worsham et al.

[11] Patent Number: 4,942,288

[45] Date of Patent: Jul. 17, 1990

[54] BAKING OVEN

[76] Inventors: Dillard D. Worsham; Janet M. Worsham, both of P.O. Box 507, Delhi, Calif. 95315

[21] Appl. No.: 321,790

[22] Filed: Mar. 10, 1989

[51] Int. Cl.[5] ..... F24C 7/00; F24C 15/34

[52] U.S. Cl. ..... 219/399; 219/385

[58] Field of Search ..... 219/399, 462, 454, 385, 219/386, 458

[56] References Cited

U.S. PATENT DOCUMENTS

| | | | |
|---|---|---|---|
| 1,069,440 | 8/1913 | Lawrence | 219/399 |
| 1,086,870 | 2/1914 | Sykes | 219/458 |
| 1,141,175 | 6/1915 | Copeman | 219/454 |
| 1,234,991 | 7/1917 | Winterbotham | 219/399 |
| 1,392,802 | 10/1921 | Serrell | 219/399 |
| 1,416,527 | 5/1922 | Townsend | 219/455 |
| 1,570,778 | 1/1926 | Putnam | 219/455 |
| 2,919,339 | 12/1959 | Hilliker | 219/399 |

FOREIGN PATENT DOCUMENTS

| | | | |
|---|---|---|---|
| 639912 | 7/1928 | France | 219/385 |

*Primary Examiner*—Teresa J. Walberg

*Attorney, Agent, or Firm*—Leon Gilden

[57] ABSTRACT

A baking oven is set forth employing heat transfer of a relatively thick metal slab oriented within an oven that is formed with a removable insulated cover positionable over a support base. The support base is provided with a single low temperature heating element to direct heat to an overlying metal slab to provide continuous and even heat over a prolonged period of time to enable baking of items within the oven utilizing minimal cooking oils and the like during the baking process.

11 Claims, 3 Drawing Sheets

BAKING OVEN

BACKGROUND OF THE INVENTION

1. Field of the Invention

The field of invention relates to ovens, and more particularly pertains to a new and improved baking oven utilizing energy transfer through an enlarged slab overlying the heating element to provide continuous and even baking.

2. Description of the Prior Art

The use of baking ovens is well known in the prior art. The baking ovens of the prior art have utilized complex and relative elaborate thermostats, heat controls, and the like, to provide even and continuous baking of item within an oven. The instant invention attempts to overcome the deficiencies of the prior art by providing a single temperature heating element to effect baking over a prolonged period of time and providing continuous and even heat within the confines of the oven. Examples of prior art include U.S. Pat. No. 4,496,827 to Strudevant utilizing a plurality of low potential electrodes, one fixed and the other movable, positionable within the oven to provide even and continuous heat within the oven interior.

U.S. Pat. No. 4,523,082 to Strudevant sets forth an electrode shield providing a shield in conjunction with a needle electrode for preventing the needles to establish current contact with high potential foods and the like.

U.S. Pat. No. 4,215,266 to Smith sets forth a baking oven with a baking chamber divided in a plurality of compartments with a thermostat anad other control features to provide various baking gradients and maintaining of such gradients within the oven.

U.S. Pat. No. 3,812,908 to Conville sets forth an isothermal oven utilizing a heat pipe with the heating means covered with a capillary structured in contact with liquid to be evaporated within the oven confines.

U.S. Pat. No. 3,731,039 to Beech set forth an electrically heated oven utilizing refractory layers built up from cast pieces of refractory material contained within sheet metal trays with heating elements positioned forwardly thereof to provide an even heating within the oven.

As such, it may be appreciated that there is a continuing need for a new and improved baking oven wherein the same overcomes the deficiencies of the prior art by providing a baking oven addressing the problems of providing even heat with a minimal of control components, and in this respect, the present invention substantially fulfills this need.

SUMMARY OF THE INVENTION

In view of the foregoing disadvantages inherent in the known types of baking ovens now present in the prior art, the present invention provides a baking oven wherein the same includes a relatively large slab-like heated mass member to direct continuous and even heat to the interior of the oven during a baking procedure. As such, the general purpose of the present invention, which will be described subsequently in greater detail, is to provide a new and improved baking oven which has all the advantages of the prior art baking ovens and none of the disadvantages.

To attain this, the present invention includes a baking oven provided with a base including an upwardly extending heating rack of polygonal configuration with a heating element secured to the base provided with a heat shield therearound with a slab-like heat-sink member of a geometric configuration equal to that of the associated rack to direct heat upwardly of the heating element to food contained within the rack. The slab is of a relative massive configuration, weighing approximateely twenty-four pounds, within an interior oven compartment of substantially one foot cubic dimensional construction. The single heating element is to provide a temperature directed at the slab of substantially two hundred to two hundred fifty degrees F. and typically utilizes seven hundred to twelve hundred watts, dependent on the size of the element. The heat shield about the element interfits within a groove within an underside of the slab fo further ensure proper orientation of the slab relative to the heating element.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of te claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baking oven which has all the advantages of the prior art baking ovens and none of the disadvantages.

It is another object of the present invention to provide a new and improved baking oven which may be easily and efficiently manufactured and marketed.

It is a further object of the present invention to provide a new and improved baking oven which is of a durable and reliable construction.

An even further object of the present invention is to provide a new and improved baking oven which is susceptible of a low cost of manufacture with regard to both materials and labor, and which accordingly is then susceptible of low prices of sale to the consuming public, thereby making such baking ovens economically available to the buying public.

Still yet another object of the present invention is to provide a new and improved baking oven which provides in the apparatuses and methods of the prior art some of the advantages thereof, while simultaneously overcoming some of the disadvantages normally associated therewith.

Still another object of the present invention is to provide a new and improved baking oven wherein the same utilizes an enlarged slab to present heat transfer of constant temperature within the confines of an oven provided with a removable outer cabinet-like structure positionable upon a base containing a heating element and the associated slab.

These together with other objects of the invention, along with the various features of novelty which characterize the invention, are pointed out with particularity in the claims annexed to and forming a part of this disclosure. For a better understanding of the invention, its operating advantages and the specific objects attained by its uses, references should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
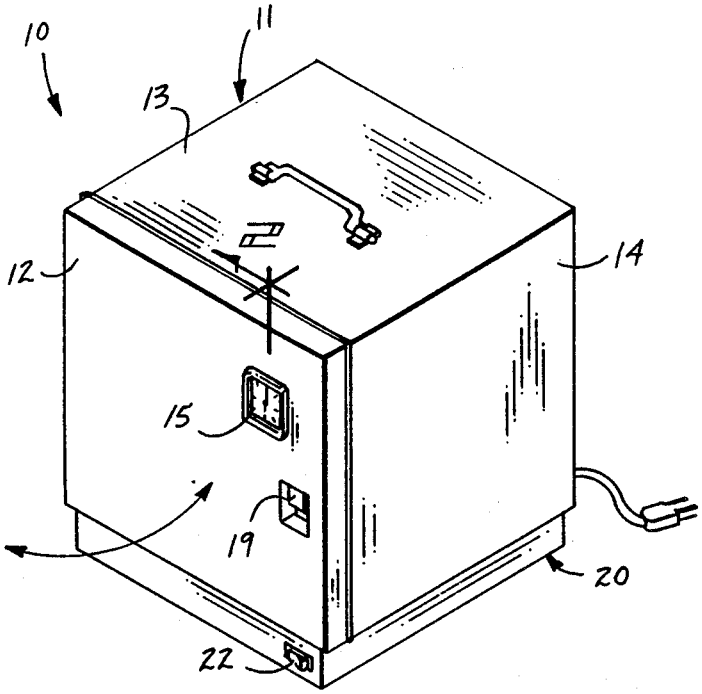
FIG. 1 is an isometric illustration of the instant invention.

With reference now to the drawings, and in particular to FIGS. 1 to 5 thereof, a new and improved baking oven embodying the principles and concepts of the present invention and generally designated by the reference numeral 10 will be described.

Figure 2:
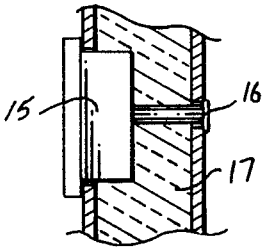
FIG. 2 is an orthographic view, of section line 2 of FIG. 1.
Figure 3:
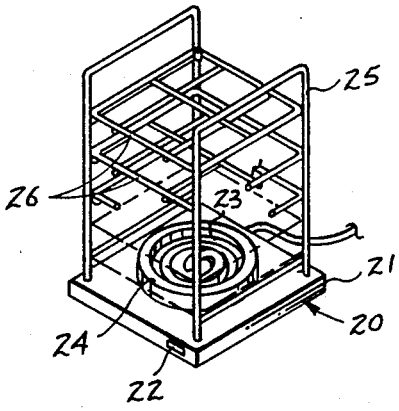
FIG. 3 is an isometric illustration of the base and upwardly extending rack structure of the instant invention.
Figure 4:
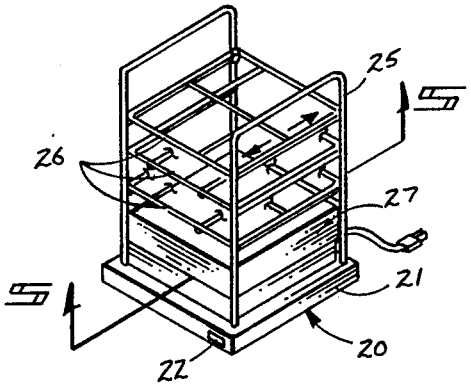
FIG. 4 is an isometric illustration of the base and upwardly extending rack and positioned heat slab of the instant invention.
Figure 5:
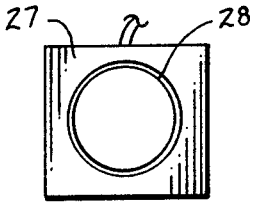
FIG. 5 is an orthographic view, taken along the lines 5—5 of FIG. 4, in the direction indicated by the arrows.
Figure 6:
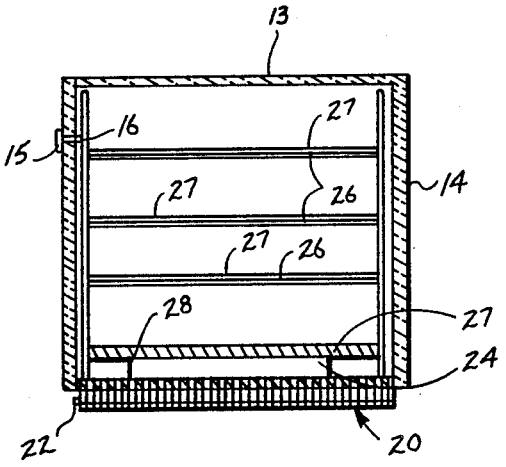
FIG. 6 is a cross-sectional illustration of the instant invention.

More specifically, the baking oven apparatus 10 of the instant invention essentially comprises an insulated hood 11 removably mounted and positionable in engagement with an underlying base portion 20. The insulated hood 11 includes a pivotally mounted door 12, a top 13, with rear and side walls 14 to define the enclosed hood 11. The hood is positionable upon the base portion 20 during the baking process. The top is provided with a handle 13*a* for enabling ease of removal and positioning of the hood and wherein a temperature gauge 15 is positioned in a fixed manner within the door 12 and includes a probe 16 extending through an interior wall of the door to present a visual display of the temperature within the baking oven 10 during a cooking procedure. The hood is provided with insulation 17 sandwiched between interior and exterior walls. FIG. 2 illustrates the insulation formed within the door 12, but it is illustrative of that utilized within the top 13 and rear and side walls 14. The door is further provided with a latch 18 to secure the door to the remainder of the hood. The door enables access to the interior of the baking oven 10 during a cooking procedure to avoid removal of the entire hood 11 and allow escape of a majority of heat contained within the baking oven 10 during cooking procedure.

The base portion 20 includes a planar base member 21 formed with an on-off switch 22 at a forward vertical wall thereof. The switch 22 is the single control of a heating element 23 formed and secured to the upper surface of the base member 21. The heating element 23 is utilized to provide a cooking heat within the range of two hundred to two hundred fifty degrees dependent upon the heating element 23 selected. Typically a seven hundred fifty watt element is utilized but may vary from seven hundred to one thousand watts of energy to impart heat to an overlying heat slab 27. Positioned in surrounding relationship to the heating element 23 is a heat shield 24 extending continuously and upwardly about the heating element 24 and also affixed to the upper surface of the base member 21. Extending upwardly of the upper surface of the base member 21 is a rack 25 provided with a plurality stacked slidably mounted heating racks for positioning of various foods to be baked thereon.

The heat slab 27 is of a massive construction and will have a weight of twenty to thirty pounds positioned upon the heat shield 24. The heat slab 27 will be provided with a continuous groove 28 of a geometrically complementary configuration to the configuration of the heat shield 24 to receive the upper edge of the heat shield 24 therewithin and enable enhanced positioning of the heat slab 27 overlying the heat shield 24. Further, the heat slab 27 is of a geometric configuration defined by the interior dimesions of the rack 25 to provide a continuous heating surface underlying the various heating racks 26. The interior dimensions of the hood 11 are of a generally one foot cubit configuration, but may vary by a range of twelve to sixteen inch range.

Heating of slab 27 provides a continuous and relatively unwaivering source of heat once a terminal temperature in the range of two hundred to two hundred fifty degrees is attained within the slab and provides continuous baking over a prolonged period of time thereby minimizing the need for various cooking oils and the like of foods to be baked within the confines of the baking oven 10.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variation in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A baking oven comprising, a hood means including a top wall, a rear side wall, and spaced first and second side walls integrally secured together, and a closure door pivotally mounted to a first side wall and selectively securable to a second side wall, and wherein said hood means is removably mounted for overlying engagement with a base portion;

said base portion including a base member, said base member including a top surface with a heating element mounted fixedly thereon with a rack extending upwardly from said base member in surrounding relationship to said heating element, and a heat slab mounted overlying said heating element, and wherein said heating element includes a continuously formed and upwardly extending heat shield formed about said heating element, and wherein said heat slab is selectively postionable upon an upper surface of said heat shield.

2. A baking oven as set forth in claim 1 wherein said slab includes a continue groove of a geometric configuration complementary to a further geometric configuration defined by the upper surface of said heat shield.

3. A baking oven as set forth in claim 2 wherein said heat slab is substantially equal to an interior perimeter configuration defined by said rack.

4. A baking oven as set forth in claim 3 wherein said heat slab is of a weight within a range of twenty to thirty pounds.

5. A baking oven as set forth in claim 4 wherein said top wall includes a handle fixedly mounted thereon.

6. A baking oven as set forth in claim 5 wherein said closure door includes a temperature gauge integrally mounted through said door including a probe extending interiorly of the hood.

7. A baking oven as set forth in claim 6 wherein the closure door, the top top, the rear side wall, and the first and second side walls include spaced exterior and interior walls sandwiching insulation therebetween.

8. A baking oven as set forth in claim 7 wherein a single on-off switch controls the heating element.

9. A baking oven as set forth in claim 8 wherein the heating element provides heat upwardly to the heat slab, and the heating element is defined by a power consumption rate in a range of seven hundred to a thousand watts and provides heat within a range of two hundred to two hundred fifty degrees F.

10. A baking oven as set forth in claim 9 wherein the interior configurational dimension of the hood is defined by a cube defined by a lineal dimension of twelve to sixteen inches.

11. A baking oven as set forth in claim 10 wherein the rack includes a plurality of slidably mounted heating racks positioned in overlying relationship relative to one another and each said heating racks overlying said heat slab.

* * * * *